US006189884B1

(12) United States Patent
Jeske

(10) Patent No.: US 6,189,884 B1
(45) Date of Patent: Feb. 20, 2001

(54) APPARATUS FOR FORMING A GAP IN A SCALE-LIKE SHEET FLOW

(75) Inventor: Erwin Jeske, Neuffen (DE)

(73) Assignee: bielomatik Leuze GmbH & Co. (DE)

( * ) Notice: Under 35 U.S.C. 154(b), the term of this patent shall be extended for 0 days.

(21) Appl. No.: 09/430,440

(22) Filed: Oct. 29, 1999

(30) Foreign Application Priority Data

Nov. 7, 1998 (DE) ..... 198 51 371

(51) Int. Cl.[7] ..... B65H 29/68
(52) U.S. Cl. ..... 271/182; 271/183
(58) Field of Search ..... 271/182, 183

(56) References Cited

U.S. PATENT DOCUMENTS 4,546,871 * 10/1985 Duke ..... 271/182 X
5,158,278 * 10/1992 Auf der Mauer ..... 271/182 X

FOREIGN PATENT DOCUMENTS 2 307 728 9/1974 (DE) .
38 31 742 6/1989 (DE) .
39 26 966 2/1991 (DE) .
40 13 116 11/1991 (DE) .
0 497 002 8/1992 (EP) .

OTHER PUBLICATIONS

Herron, T.F.: Cut Forms Interruptor. In. IBM Technical Disclosure Bulletin, vol. 15, No. 3, Aug. 1972, S.785.

* cited by examiner

*Primary Examiner*—David H. Bollinger
(74) *Attorney, Agent, or Firm*—Akerman Senterfitt

(57) ABSTRACT

In a large-format crosscutter (11) is proposed an apparatus for forming a gap in a scale-like or regulated sheet flow. Following onto an overlapping station (13) is provided a gap formation station (19), which has a conveyor (31) which can be accelerated to a higher speed than the feed conveyor (18). For gap formation purposes a gap formation carriage (22) runs along a guide (23) in the conveying direction (15), shortens the gap formation conveyor (31) and lengthens the feed conveyor (18). A suction device (41) on the gap formation carriage is lowered somewhat and by means of a blowing device (42) air is blown into the resulting clearance. Therefore the gap formation carriage precedes the slower feed conveyor (18) and forms the necessary gap, so that in the latter can be operated a switch or points (46) for switching to a different one of the two conveying paths (47, 48).

19 Claims, 4 Drawing Sheets

APPARATUS FOR FORMING A GAP IN A SCALE-LIKE SHEET FLOW

FIELD OF APPLICATION AND PRIOR ART

In crosscutters, particularly large-format crosscutters for paper, relatively large-format sheets, mainly used as printed sheets, are cut from paper webs, quality-tested and deposited. Generally several webs coming from different paper rolls are supplied in superimposed manner to the crosscutter, so that individual sheet packs or groups are obtained, which are normally called clips. Following the crosscutter the clips are transformed in an overlapping station into a scale-like or tegulated sheet flow, i.e. mutually partially overlapping clips, which are finally deposited in a depositing or storage point or in a stacking station.

Although such paper reams or stacks in part have a very large number of single sheets (approximately 10,000 to 15,000), with the high operating speed of such crosscutters a pallet would be full with such a stack after only a few minutes. As it is impossible to entirely shutdown the machine for stack change purposes, hitherto, as a function of the crosscutter construction by means of a connecting switch or points positioned following the crosscutter a number of clips have been removed and which according to the degree of scaling at least corresponded to the length of one sheet, in order to then operate a switch or points within the gap and control the following sheet flow portion to a second depositing point on which another stack has been collected, until the first has been conveyed away and therefore the depositing point could again be made ready to operate.

In another known crosscutter construction the gap is produced in the sheet flow by an intermediate stopping of the following sheets upstream of the feeder, which is less suitable as a result of the mechanical action on the sheets with marking-sensitive sheet material, as a result of the possible damage. In another known crosscutter construction separation of the sheet flow portion takes place in the sheet depositing station with the aid of mechanical sheet clamping devices and/or intermediate collecting devices (e.g. format-wide, insertable plate tables or collecting gratings), which has given rise to relatively high technical costs and which frequently only takes place in a completely satisfactory manner under ideal conditions due to the possible damage to sensitive sheets and the in part complicated sequence of the separating movements.

Crosscutter constructions in which the gap between the sheet flow portions is produced by the discharge of sheets or clips, are generally characterized by a relatively simple, advantageous and uncomplicated stacking process, which has the advantage of a straight, clean stack edge. However, the serious disadvantage of this construction is that the discharge of good paper sheets must take place in order to form the gap. As the discharged paper constitutes waste, this is disadvantageous both economically and ecologically. As a result of this measure alone, a crosscutter could annually produce 50 to 100 tonnes of paper waste in the form of perfect quality paper.

All attempts up to now to obviate this problem have failed, which is on the one hand due to the very high web speeds, and on the other the fact that the cut papers, particularly in the case of top quality papers, are very sensitive. Even in the case of the slightest mechanical influencing, they tend to become marked and this cannot be tolerated during further processing and in the end product.

Apparatuses for forming gaps are already known in conjunction with insensitive flat materials or products produced therefrom. Thus, DE 39 26 966 C2 discloses an apparatus for forming a gap in a staggered flow of corrugated board, in which a slowly operating feed conveyor shoves the staggered sheet flow over and beyond a gap forming position onto a more rapidly operating gap formation conveyor. As a result of the movement of the gap formation position in the conveying direction and accompanied by the simultaneous raising of the feed conveyor, a gap is produced between two corrugated board sheets. This apparatus cannot be used with the necessary operational reliability for large and sensitive paper sheets, collisions occurring in the vicinity of the gap formation position.

The same document describes an apparatus, in which there are two nested belt systems with higher and lower speeds and as a result of the different position of two guide pulleys, which are displaceable, one or other belt is brought into engagement with the paper. This apparatus has the same disadvantages as that described hereinbefore and there is the additional advantage that two different belt systems must be guided in such a way that one runs into the gap of the other.

It is also known from EP 497 002 A1 to form a gap in a staggered flow of printed products, e.g. folded sheet layers, in that use is made of parallel belts with slower and higher speeds. A central conveyor belt with a higher speed, which is positioned somewhat below the plane of the adjacent belts running at a lower speed, is brought into engagement with the layers by suction air for gap formation purposes and draws the same over the slower belts until a gap is formed. This is unacceptable for papers having sensitive surfaces, because at least on the bottom sheet it leads to markings.

PROBLEM AND SOLUTION

The problem of the invention is to provide a possibility of forming a gap in a regulated sheet flow in operationally reliable manner, also in the case of sensitive materials and for high processing speeds, without it being necessary to renounce the simple sheet feeder construction, which is of an optimum nature for the stack quality.

This problem is solved by claim 1. Due to the fact that the last sheet of the front sheet flow portion, after which the gap is to be formed, is held on the gap formation conveyor and said end is also movable at the gap formation speed together with the gap formation conveyor, i.e. at a higher speed, and the fact that said end is at a lower level on the gap formation conveyor than the feed conveyor, a clean separation is achieved. The first sheet of the following sheet flow portion is separated by a vertical clearance from the last sheet of the front portion. It is particularly advantageous to have at the gap formation position a blowing device, which migrates with said position and then the first sheet of the following or trailing portion floats on an air cushion over the rear part of the front sheet flow portion, so that it can be advanced under the following portion.

As the holding means are preferably constituted by a controlled, operable suction device, which sucks through an air-permeable, e.g. perforated conveyor belt of the gap formation conveyor and there are also no belts running parallel to one another with different speeds and instead they only run successively, there are no relative speeds between the sheet and the belts, so that there is no need to fear any marking of sensitive sheets. The feed conveyor, which preferably runs more slowly than the conveying speed in the crosscutter area can be the one on which the staggered sheet flow is formed and directly thereafter can commence the gap formation station. Through a corresponding length compensating device the feed conveyor can be lengthened in such a way that it follows the gap formation position on initiating the gap formation process. There is a corresponding shortening of the gap formation conveyor. Normally the feed conveyor and gap formation conveyor operate at the same speed until the gap formation process is initiated.

Directly following the gap formation station can be provided a switch or points for the lossfree subdivision of the sheet flow over two conveying paths switched in the gap formed. This avoids the hitherto necessary discharge of part of the products as waste, when said subdivision is required for stack changing or other purposes. In another advantageous construction, this gap formation station, even without any subdivision into different feed quantities, can be upstream of a stack formation device, e.g. a so-called single sheet feeder and in this case it is possible to provide a sheet feeder with an automatic pallet changer in a simple construction which is still of an optimum nature for stack formation and consequently no product quality losses occur. Then e.g. only a single vertical stack is produced, which requires no auxiliary stack formation or sheet separating elements.

These and further features can be gathered from the claims, description and drawings and the individual features, both singly and in the form of subcombinations, can be implemented in an embodiment of the invention and in other fields and can represent advantageous, independently protectable constructions for which protection is hereby claimed. The subdivision of the application into individual sections and the subtitles in no way limits the general validity of the statements made thereunder.

BRIEF DESCRIPTION OF THE DRAWINGS

An embodiment of the invention is described in greater detail hereinafter relative to the attached drawings, wherein show.

DESCRIPTION OF THE PREFERRED EMBODIMENT

Figure 1:
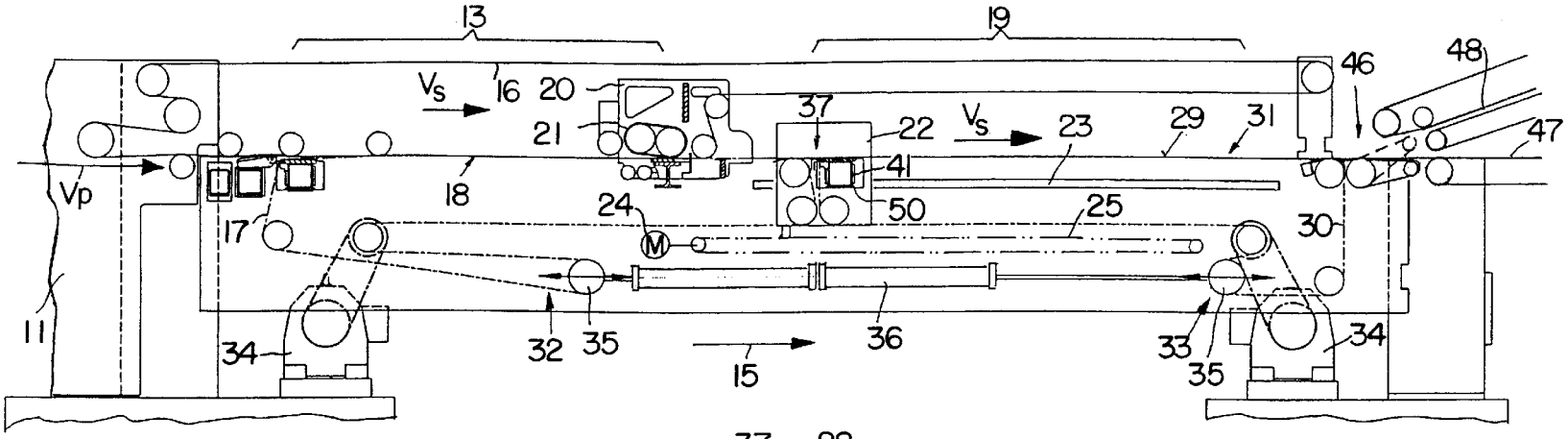
FIG. 1 A diagrammatic view of part of a crosscutter with an overlapping and gap formation station.

The drawings show a portion of a crosscutter 11, which can be a large-format or folio crosscutter. To the left of the crosscutter portion shown in FIG. 1 are provided paper rolls from which numerous, e.g. six individual paper layers can be drawn and which are brought together in superimposed manner to form a web, which is cut into individual sheets by a rotating crosscutter blade. In conjunction with the present application the term sheet or clip is used to describe both a single sheet and a group of several, jointly cut single paper layers in the corresponding format. Upstream of the crosscutter the individual papers can pass e.g. through optical sensor means, which detect and record paper faults, so that the sheets containing them can be specially handled, e.g. discharged. As a preparation for stack formation the individual clips 12 are then transferred into an overlapping station for overlapping or staggering to form a scale-like or regulated sheet flow 14.

The clips arriving in the conveying direction 15 are guided in the overlapping station between upper belts 16 and lower belts 17, which together form a feed conveyor 18 for the following gap formation station 19 and in each case the top clip is decelerated by a braking station 20. This braking station is described in detail in DE 38 12 685 A, to which reference can be made for constructional and functional details. For adapting to the different format lengths the braking station 20 with its braking belts 21 can be displaced in the conveying direction, which is permitted by a corresponding guidance of the upper and lower belts 16 and 17.

To the gap formation station 19 belongs a gap formation carriage 22, which is movable along a horizontal guideway 23, e.g. a ball guide in or counter to the conveying direction and namely by a drive not shown in FIG. 1, which can e.g. be an electric, hydraulic or pneumatic linear drive or also, derived from the overall drive of the crosscutter, by means of a mechanical gear or lever gear, couplings, etc. FIG. 1 diagrammatically shows an independently controlled drive 24 with an electric motor and continuous driving belts 25 for the same guided over two pulleys.

The gap formation carriage 22 shown in FIGS. 2, 4, 6 and 8 in an in each case larger scale compared with the preceding drawings, contains guide pulleys 26 for the lower belt 17 of the feed conveyor 18 and guide pulleys 27, 28 for a belt 30 running under the conveying plane 29 of the gap formation station 19 and which belongs to a gap formation conveyor 30. It is air-permeable, e.g. as a result of perforations.

Both lower belts 17, 30 are guided by means of length compensating devices 32, 33 and are driven by drives 34 with a controllable speed. The length compensating devices 32, 33 have horizontally movably guided guide pulleys 35, which e.g. through pneumatic spring cylinders 36 keep the belts taut, but permit a movement of the gap formation carriage 22 along the guide 23 even during the running of belts 17, 30. The end of the effectiveness of the feed conveyor 18 in the form of the guide pulleys 26 and in particular the start of the gap formation conveyor 31 with the belt 30 at the position of the guide pulleys 27, 28 define between them a gap formation position 37, which is substantially horizontally displaceable along the guide 23 in the conveying direction 15, together with the gap formation carriage 22.

The gap formation carriage 22, which could also be called a sliding carriage or movable frame, contains a controllable suction device 41, which comprises a horizontal suction duct 38 running transversely to the conveying direction 15 and having upper, slide-controlled suction openings 39. The suction device 41 movable horizontally with the gap formation carriage 22 and to a limited vertical extent together with a suction table 40 having the suction openings 39 (cf. FIG. 4), is connected e.g. by means of a not shown, flexible suction hose to a vacuum source, e.g. a suction fan or a suction air or vacuum network belonging to the overall machine.

FIGS. 2, 4, 6 and 8 also show a blowing device, which is connected by means of a blowing or compressed air duct 43 and also a flexible hose to a compressed air source in the form of a fan or a compressed air network. This connection takes place by means of a blowing air control device 44, diagrammatically indicated in FIG. 2 and in the form of an electrically operable valve or slide valve. The control of the suction and blowing device 41, 42 can also take place in some other way, but as a result of the rapid reaction should occur as close as possible to the suction openings 39 or the blowing air nozzles 45, which as flat jet or slot nozzles should be uniformly distributed over the gap formation station width and preferably without large intermediate spaces. The slide control of the suction openings 39 can e.g. take place by a slide 49 displaceable relative to and inserted in the suction table 40. It can be constructed in accordance with DE 195 10 364 A1, to which reference is made here.

Following the gap formation station 19 and gap formation conveyor 31 is provided a switch or points 46, which switches the sheet flow between two different conveying paths 47 (in this case horizontal) and 48 (sloping upwards). Both run to different, not shown collecting stations, in which the sheet flow is in each case collected in a relatively high stack on a pallet. As a function of a counter, separating strips can be introduced, which within the stack separate reams with a specific number of sheets. The two conveying paths 47, 48 are alternatively used, so that during the operation of the machine in each case one collecting station is supplied, whereas the other can be cleared by conveying away the stack.

FUNCTION

The succeeding clips 12 in the conveying direction 15 arrive at the production speed $V_P$ at the inlet of the overlapping station 13 and are taken from the lower speed $V_S$ of the feed conveyor into the overlapping or scale-formation station. Braking belts 21 in the braking station 20 act on the leading edges of the in each case top sheet and decelerate the same, after being previously shoved over the slower, lower sheet. The braking station 20 is horizontally displaceable for adapting to the format length in the conveying direction and for setting purposes counter thereto.

Figure 2:
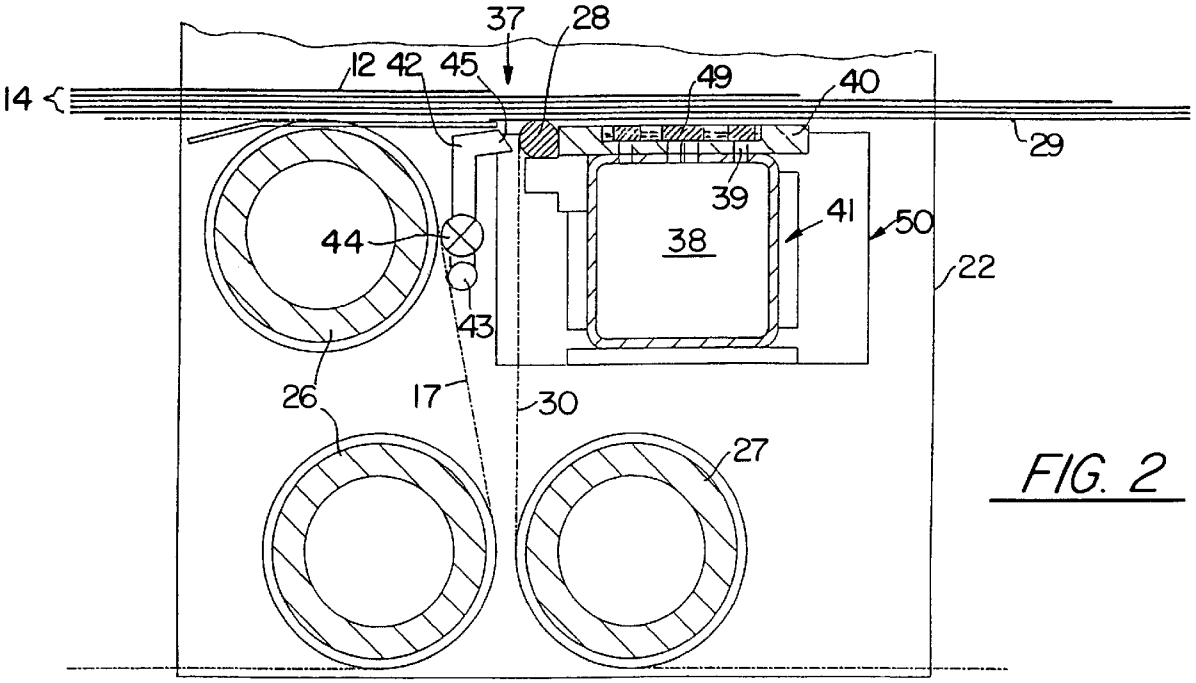
FIG. 2 A larger-scale, diagrammatic view of a gap formation carriage in the operating position shown in FIG. 1.

After this the staggered sheet flow 14 runs into the gap formation station 19. During normal operation, i.e. when cut and staggered sheets are deposited in a stack, namely that following the conveying path 47, the staggered sheet flow passes at speed $V_S$ over and beyond the gap formation carriage 22 on the gap formation conveyor 31 driven at the corresponding speed $V_S$. In the position shown in FIG. 1, i.e. related to the conveying direction 15, the gap formation carriage 22 is in the furthest upstream position. FIG. 2 shows that the suction device 41 with the suction table 40 and the guide pulley 28 linked therewith are in a raised position, i.e. the conveying plane 29 is in the extension of the feed conveyor 18. Thus, in this operating state the gap formation conveyor 31 merely forms an extension of the feed conveyor 18. The switch 46 is e.g. in the lower position and the sheet flow passes over the conveying path 47 into the connected collecting station. The suction and blowing device 41, 42 is not in operation, i.e. the corresponding valves or slide valves 44, 49 are closed. The crosscutter can operate at web speeds of 300 to 400 m/min, so that despite the relatively great sheet length 300 to 500 cuts per minute can be performed and roughly 1800 sheets per minute can pass through in the case of six single sheets per clip. Thus, a stack containing approximately 10,000 single paper sheets is full after about six minutes and must be conveyed away.

The crosscutter cannot be stopped for this purpose, because this would require a very considerable installation cost, including considerable paper losses for restarting, but in the case of very rapidly operating crosscutters it may be possible to somewhat reduce the production rate $V_P$, as a function of the sheet materials to be processed for stack changing purposes.

Figure 3:
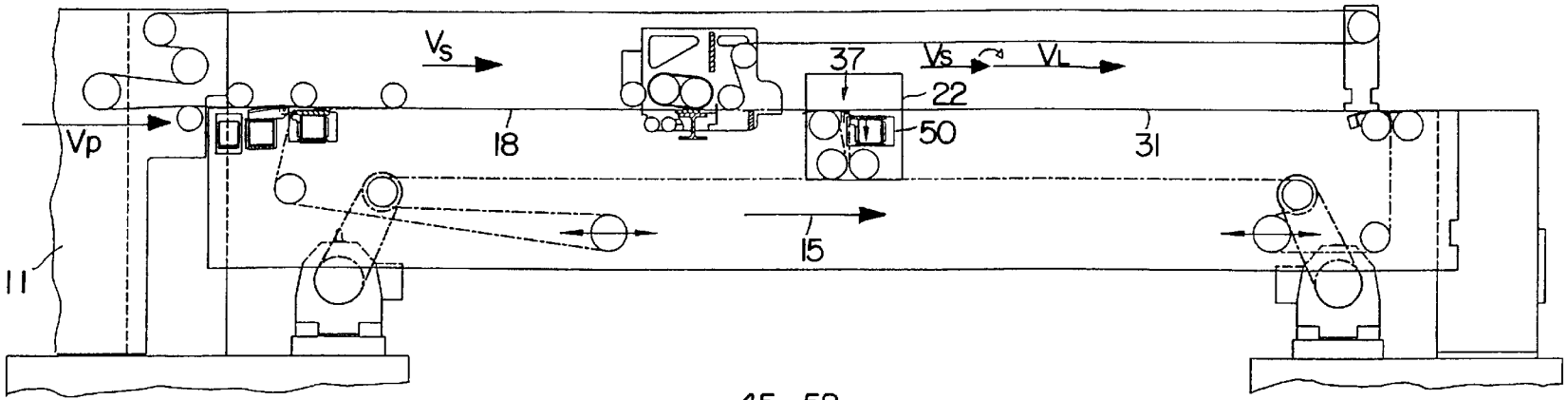
FIGS. 3 & 4, 5 and 6 and 7 & 8 In each case representations corresponding to FIGS. 1 and or 2 in other operating positions, certain auxiliary and connecting units being omitted compared with FIG. 1.
Figure 4:
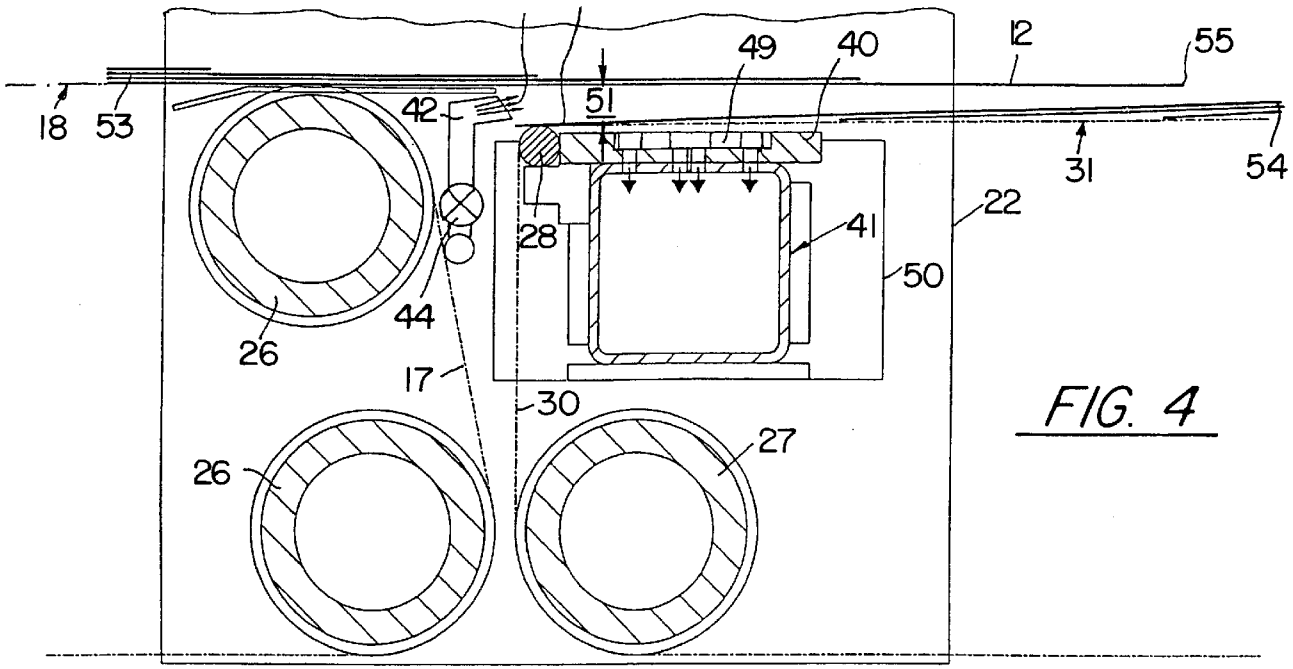

The gap formation process then commences. As shown in FIGS. 3 and 4, the gap formation carriage 22 is still in the upstream position (to the left). The unit formed by the suction device 41/suction table 40/guide pulley 28, which form vertically movable holding means 50 with respect to the suction carriage 22, is lowered by e.g. 10 to 30 and preferably about 20 mm, which forms a pronounced, vertical clearance 51 between the suction table 40 and the feed conveyor 18 and therefore between the sheets located thereon.

Simultaneously by opening the slide 49 and the valve 44 both the suction device and the blowing device are put into operation. The suction device sucks air through the perforated conveyor belt 30 of the gap formation conveyor 31 and consequently holds firmly the rear end 52 of the last sheet or clip 12 in the conveying direction 15, which prior to the lowering of the holding means 50 was on the gap formation conveyor 31. Although the suction action only holds the bottom paper sheet of the clip, as a result of the preceding processing the clips are so closely superimposed that their natural cohesion is sufficient in order to secure the entire clip.

As a result of the blowing air introduced, which passes out of the slot nozzles 45, an air cushion is produced in the clearance 51. The clearance 51 is roughly wedge-shaped, because as a result of the lowering of the holding means 50 and therefore the guide pulley 28 the gap formation conveyor is slightly upwardly directed. On said wedge-shaped air cushion the first sheet 12, in the conveying direction, of the following sheet flow portion 53 in the conveying direction can be separated from the last sheet of the preceding sheet flow portion and can so-to-speak hover over the same.

Simultaneously the gap formation conveyor 31 is now brought to a higher speed, namely the gap formation speed $V_L$ and by operating the drive 24 shown in FIG. 1 the gap formation carriage 22 is moved along the guide 23 with the gap formation speed $V_L$.

Figure 5:
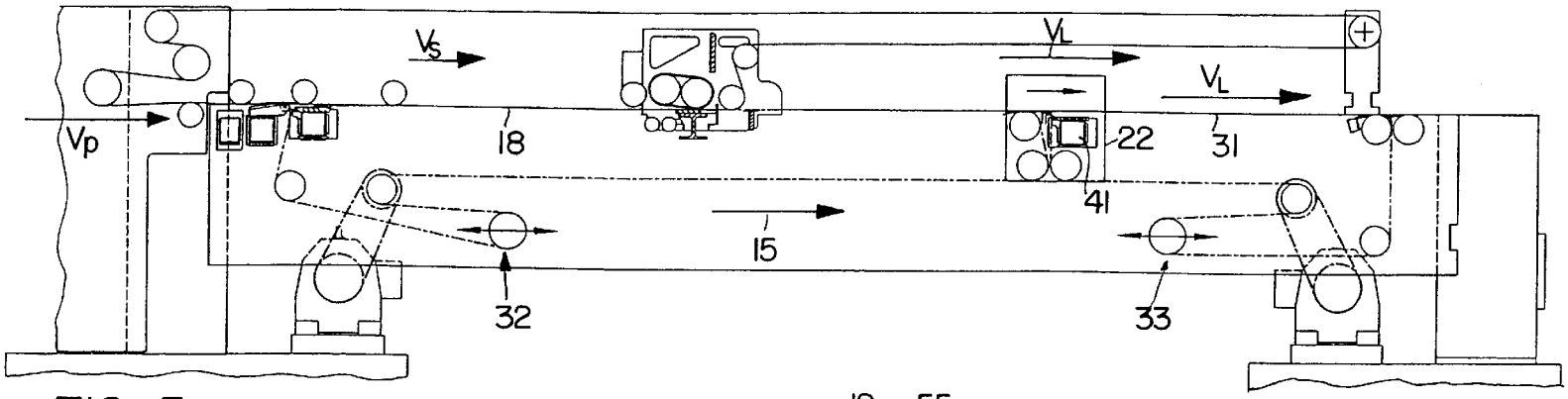
Figure 6:
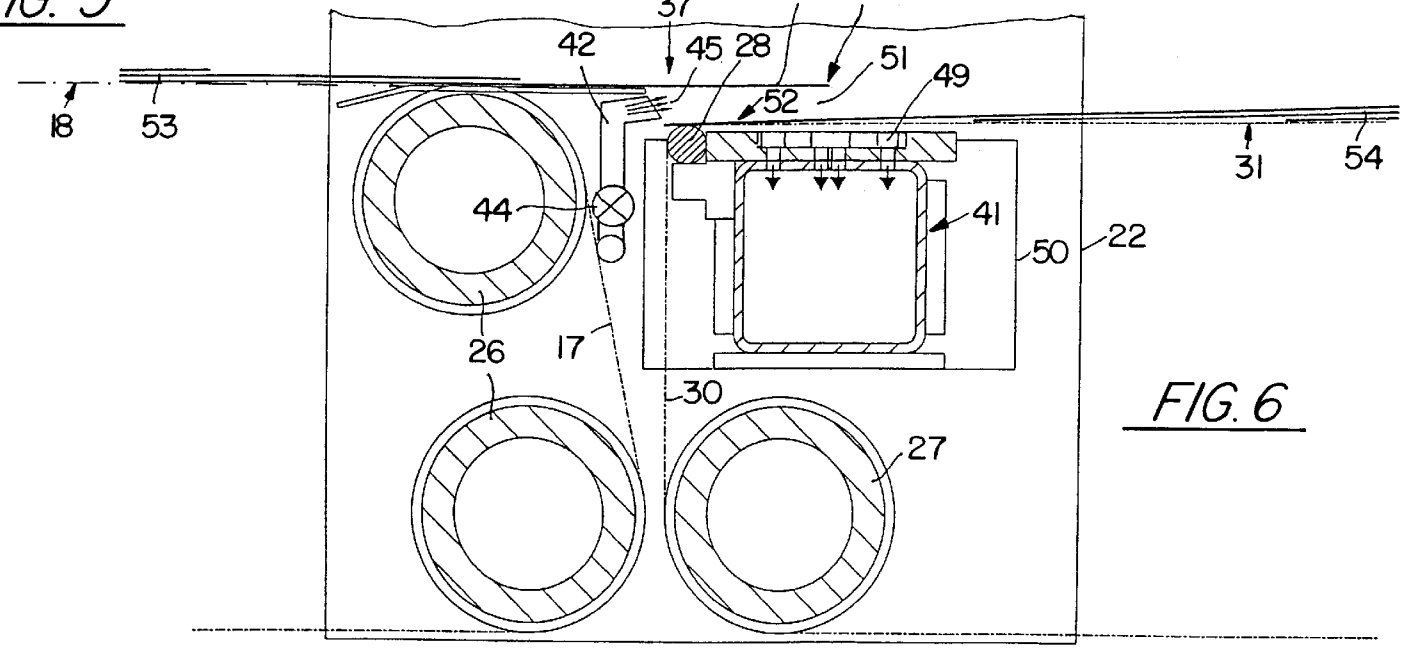

FIGS. 5 and 6 show an operating position during the gap formation process.

In FIG. 5 the gap formation carriage 22 has already moved at the gap formation speed $V_L$ by a distance in the conveying direction 5. The suction device 41 is still in operation and firmly holds the rear end 52 of the preceding sheet flow portion 54 on the gap formation carriage 22, blowing air still flows out of the blowing device 42 with the nozzles 45 and the holding means 50 are still in the lowered position.

It can be seen that the rear end 52 of the preceding sheet flow portion 54 has largely drawn forward under the first sheet 12 of the following sheet flow portion 53 and the overlap has reduced to a very small amount. As from this position the blowing air is scarcely necessary and can either be reduced or completely switched off, also in order to prevent the sheet waving or fluttering under the influence of the blowing air. The blowing air should certainly be switched off when the suction device is switched off.

FIG. 5 shows that through the movement of the gap formation carriage 22 the conveyor belts 17, 30 of the feed conveyor 18 and the gap formation conveyor 31 have lengthened or shortened in the conveying direction. This is made possible by the length compensating devices 32, 33, which release the necessary belt length or take up the belt length rendered free. As the movement of the gap formation carriage 22 takes place at the same speed $V_L$ as the belt 30, the guide pulleys 27, 28 at the gap formation carriage 22 can be stationary, whereas the guide pulleys 26 of the feed conveyor running at the slower speed $V_S$ run backwards. Due to the fact that both conveyors have their ends at the gap formation carriage 22, the gap formation position 37 moves with the gap formation speed $V_L$ and, considered relative to the gap formation carriage 22, the following sheet flow portion 53, seen from the carriage 22, is retracted onto the rearwardly running feed conveyor 18. In the case of the preceding sheet flow portion 54 the degree of overlapping does not have to be changed, although said conveyor moves faster. The speed difference leads to a gap being formed between the two portions. During the further running of the gap formation carriage 22 in the conveying direction 15 the slight overlap still visible in FIG. 6 is completely eliminated and a clear gap 56 (FIG. 8) is formed between the rear end 52 of the preceding portion 54 and the start 55 of the following portion. Through a corresponding choice of the length and the speed differences as a function of the sheet format and degree of overlap, said gap can be made as large as necessary.

Figure 7:
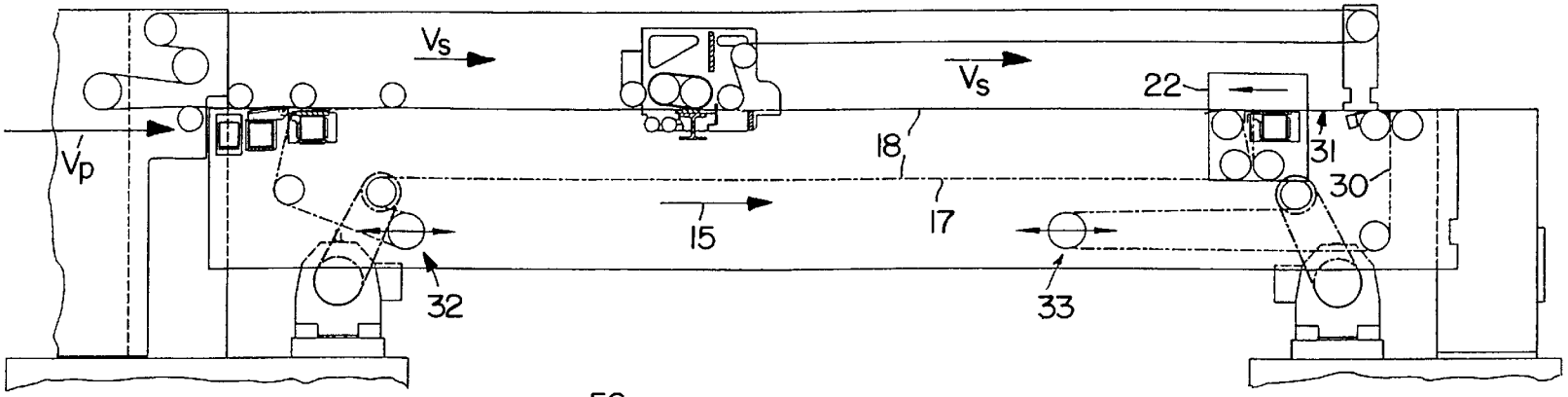
Figure 8:
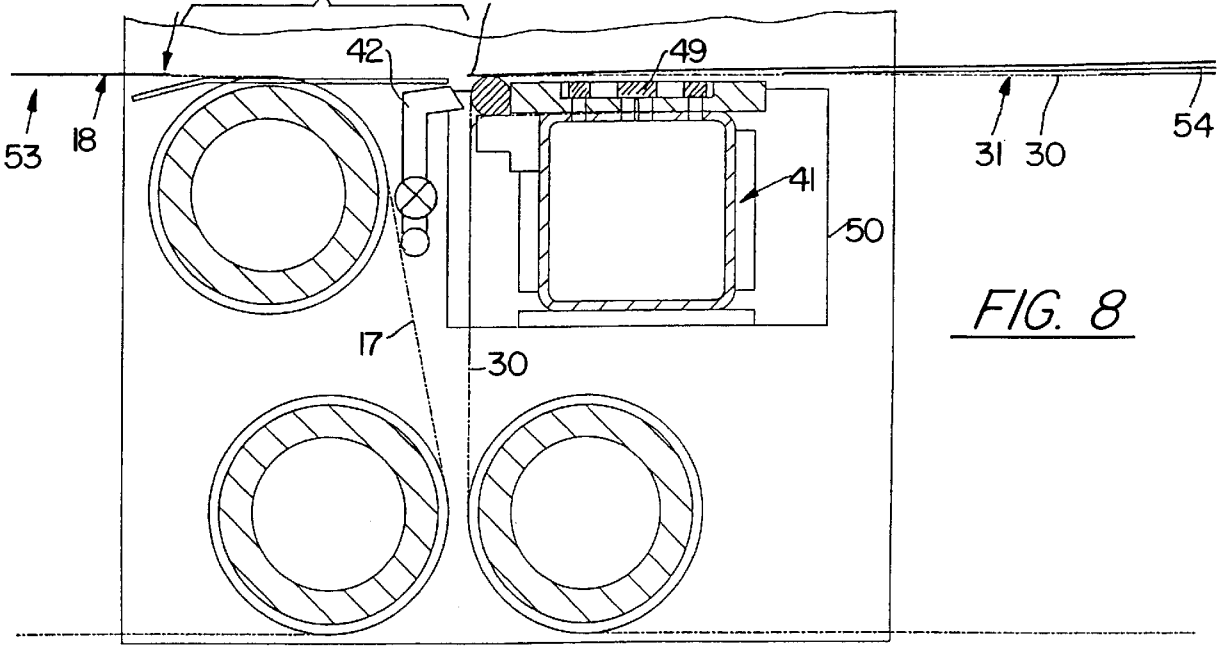

In FIGS. 7 and 8 the gap formation process is ended. The gap 56 is visible in FIG. 8, the blowing and suction air are switched off and the holding means 50 have again been drawn into their upper position, where the feed and gap formation conveyors 18, 31 are aligned. If the production rate $V_P$ had been reduced, it can now be increased again.

When the rear end 52 has passed the switch 46 shown in FIG. 1, the switch arm is moved in upwardly inclined manner from the position shown in continuous line form into the broken line position, namely within the gap 56. The start 55 of the following sheet flow portion 53 now runs on the conveying path 48 into a newly forming stack, whereas the previous stack on the conveying path 47 is removed. At the end of the gap formation process, where the gap formation carriage 22 is at the conveying direction-side of its movement path, simultaneously with the stopping of the carriage 22 the speed of the gap formation conveyor 31 is reduced from the higher speed $V_L$ to that of the feed conveyor $V_S$. The gap formation carriage 22 can now be returned at a random time prior to the next gap formation process, which will only take place in a few minutes, to its position according to FIG. 1. As a result of the conveyor belts running over it at the same speed, as in the overall gap formation process, there are no speed differences between the belts and the sheet. The carriage so-to-speak rolls in frictionless manner under the following sheet flow 53 back into its starting position.

It is clear that the gap formation apparatus according to the invention permits a process where it is possible to avoid any friction between the sheets and apparatus parts and also between the individual sheets. In particular, there is no need for parallel-running belt suctions having different speeds. In the case of the acceleration of the gap formation conveyor 31 necessary for increasing the speed of the leading portion 54, the last clip covering the clips upstream thereof is drawn onto it by the suction action and consequently not increases for itself, but also for the upstream clips the static friction on the conveyor belt 30, so that it is possible to transfer the accelerating forces without any slip tendency.

What is claimed is:

1. Apparatus for forming a gap between first and second portions of a staggered sheet flow, said flow containing mutually partly overlapping sheets, comprising:

a feed conveyor moveable in a conveying direction and having, in the conveying direction, a front end;

a gap formation conveyor, also moveable in the conveying direction and having a gap formation position situated at an effective tail end of the gap formation conveyor, regarded in the conveying direction;

the feed conveyor feeding the sheet flow with a feed speed (Vs) to the gap formation position;

the effective tail end being, for gap formation purposes, movable in the conveying direction at a gap formation speed (VL) which is higher than the feed speed (Vs);

the effective tail end of the gap formation conveyor being movable to a lower level than the front end of the feed conveyor; and holding means for a last sheet of the first sheet flow portion, being provided in an area of the gap formation conveyor (31) following in the conveying direction on the gap formation position;

said holding means being jointly movable with the effective tail end of the gap formation conveyor in the gap formation speed (VL) and in the conveying direction.

2. Apparatus according to claim 1, wherein the apparatus is a large-format crosscutter for the paper.

3. Apparatus according to claim 1, wherein the holding means incorporate a controllably operable suction device.

4. Apparatus according to claim 3, wherein the gap formation position is provided on a gap formation carriage movable in the direction, which carriage contains the suction device and rear conveyor belt guides for the gap formation conveyor and front conveyor belt guides for the feed conveyor.

5. Apparatus according to claim 4, wherein the suction device has a suction duct situated adjacent to the gap information position on the gap formation carriage and directed transversely to the conveying direction, which suction duct has suction openings under an air-permeable conveyor belt of the gap formation conveyor and which can be opened and closed by means of a controlled operable slide located at said openings.

6. Apparatus according to claim 1, wherein the front end of the feed conveyor is movable in the conveying direction with the gap formation speed to keep close to the gap formation position.

7. Apparatus according to claim 1, wherein the conveyors further comprise length compensating devices.

8. Apparatus according to claim 7, wherein the compensating devices further comprise compensating rolls tensioned by pneumatic cylinders.

9. Apparatus according to claim 1, wherein a blowing device is provided in the vicinity of the gap formation position, which blowing device is movable with the gap formation position in the conveying direction and is directed onto a clearance between the feed and gap formation conveyors with a blowing direction located substantially in the conveying direction.

10. Apparatus according to claim 9, wherein the blowing device is periodically operable.

11. Apparatus according to claim 9, wherein the blowing device has flat jet nozzles extending over the entire sheet width.

12. Apparatus according to claim 1, wherein the holding means further comprise lowering means for lowering a suction device and a guide pulley of the gap formation conveyor, nozzles of a blowing device being directed for blowing into a substantially horizontal clearance formed by said lowering.

13. Apparatus according to claim 1, wherein the conveyors have interconnected overlap-free conveyor belts along the conveying area.

14. Apparatus according to claim 1, wherein, in the conveying direction and following onto the gap formation position is provided a switch for subdivision of the sheet flow over two conveying paths.

15. Apparatus according to claim 1, wherein in the conveying direction following onto the gap formation station is provided a stack forming device.

16. Apparatus according to claim 1, further comprising means for reducing the feed speed (Vs) of the feed conveyor during gap information.

17. A method for forming a gap between first and second portions of a staggered sheet flow, said flow containing mutually partly overlapping sheets, comprising the steps of:

transporting the sheet flow on a feed conveyor to a gap formation position in a conveying direction with a feed speed (Vs), the gap formation position being formed on, regarded in the conveying direction, an effective tail end of a gap formation conveyor;

moving said tail end in the conveying direction at a gap formation speed (VL), which is higher than the feed speed (Vs);

moving the effective tail end of the gap formation conveyor to a lower level relative to a front end of the feed conveyor;

retaining the last sheet of the first sheet flow portion in an area of the gap formation conveyor adjacent to the gap formation position;

and moving the area jointly with the effective tail end of the gap formation conveyor in the conveying direction at the gap formation speed (VL).

18. Method according to claim 17, wherein the retaining includes suction excerted to said last sheet, the suction being switched on when the gap formation position is situated in its remote position counter to the conveying direction.

19. Method according to claim 17, wherein the feed speed (Vs) of the feed conveyor is reduced during gap formation.

* * * * *